US005184817A

United States Patent [19]

Kanelous

[11] Patent Number: 5,184,817

[45] Date of Patent: Feb. 9, 1993

[54] GOLF PUTTING AID

[75] Inventor: Kanelos J. Kanelous, Palm Harbor, Fla.

[73] Assignee: Greenreader Inc., Clearwater, Fla.

[21] Appl. No.: 738,687

[22] Filed: Jul. 31, 1991

[51] Int. Cl.[5] ..... A63B 69/36; A63B 57/00

[52] U.S. Cl. ..... 273/32 H; 434/252; 283/117

[58] Field of Search ..... 273/32 H, 183 A, 183 E, 273/32 R, 32 B, 35 R, 177 R; 434/252; 283/117

[56] References Cited

U.S. PATENT DOCUMENTS

| | | | |
|---|---|---|---|
| 3,293,755 | 12/1966 | Cronwell | 273/32 H |
| 3,535,792 | 10/1970 | Douglas | 273/32 H |
| 3,679,206 | 7/1972 | Shambaugh | 273/32 H |
| 3,820,786 | 6/1974 | Candor | 273/32 H |
| 4,137,447 | 1/1979 | Smith | 273/32 H X |
| 4,824,114 | 4/1989 | Catalano | 273/32 H |
| 4,984,791 | 1/1991 | Labell | 273/32 H |
| 5,014,994 | 5/1991 | Peters | 273/32 H |

*Primary Examiner*—George J. Marlo

*Attorney, Agent, or Firm*—David Kiewit

[57] ABSTRACT

Most golf greens slope, which causes balls that are putted on them to follow curves, rather than moving in straight lines. An heuristic visual device is provided to assist a golfer in estimating how a putted golf ball will "break" on a sloping green. The invention provides graphic representations of trajectories of putted golf balls rolling on greens that slope solely along principal directions (i.e. front-to-back and right-to-left). A golfer, who must initially estimate how the green on which he is planning to putt actually slopes in the two principal directions, can metally combine those graphically represented putting trajectories in order to estimate the effects of gravity and thereby to predict his proper 'line of play'. In a preferred embodiment, a transparent substrate, which has putting trajectories from a green that slopes solely from front to back printed on its top surface and putting trajectories from a green the slopes solely from left to right printed on its bottom surface, is used to facilitate the golfer's mental process of superimposing those trajectories to arrive at a net estimated trajectory.

6 Claims, 4 Drawing Sheets

GOLF PUTTING AID

BACKGROUND OF THE INVENTION

The present invention provides a means to aid golfers in visualizing the effect of gravity on a putt or other golf stroke that causes a ball to roll across a sloped surface.

Greens on golf courses are generally sloped to provide drainage for the grass and challenge for the golfer. In order to avoid standing water the green usually has no local low spots or concavities. Thus, a green is usually either planar or crowned (i.e. higher in the middle than at the edges). Moreover, the front of the green (i.e. that portion closer to the tee) is generally lower than the back of the green so that the golfer can "hold" the green on approach shots.

When a green slopes, the path along which the ball must be putted in order for it to reach the cup is usually not the same as the straight line of sight from the ball to the cup. Unless the line of sight from the ball to the cup is directly uphill or directly downhill, gravity will cause the ball to "break" away from that line. In order to succeed at putting, the golfer must predict the break, which is a function of both the slope and the "speed" of the green. "Speed", a complex function of the height of the grass, dampness of the green, etc., is estimated subjectively by the golfer, based on his experiences with similar greens. Slope, on the other hand, is far more tractable to measurement and the prior art is replete with devices that allow a golfer to "read" the slope of the green. Notable among these are U.S. Pat. Nos.

- 4,984,791 to Labell, who teaches the use of a pair of bubble levels to allow the golfer to measure the slope of the green in two perpendicular directions,
- 4,821,114 to Catalano, who uses a plumb bob inside a putter to measure the slope and to indicate a predicted path for the ball,
- 3,679,206, to Shambaugh, who teaches a multi-part device that indicates a line of swing for a selected one of a variety of clubs if the golfer is to hit a ball from a "cross-hill lie",
- 3,535,792, to Douglas, who employs a pendulum to determine a vertical direction and a manually pivoted scale set to visually match the surface of the green, thereby displaying the angle of the slope, and
- 3,293,755, to Cronwell, who employs a pendulum that is constrained to move in a single plane and that is part of a rotatable body that can, if once read and twice rotated, indicate a stroking direction for a putt.

Although the aforementioned instruments may be useful as training aids, the "Rules of Golf" (published by the United States Golf Association as Publication 14-3) forbids the use of devices or equipment that measure or gauge distance or conditions.

With or without the aid of a measuring device, a successful putt requires that the golfer estimate the net slope of the green, preferably by first reading the slope in two perpendicular directions and then assessing the effect of gravity on his putt in order to select an initial stroking direction. Many golfers take pains to observe the slopes, but still misread the green by erring when they mentally combine the effects of the two slopes. When this happens, the golfer may, for example, stroke his putt along an initial path that is to the left of the cup, and watch in frustration as the ball breaks even further to the left.

SUMMARY OF THE INVENTION

The present invention provides a device and method to aid golfers in predicting the path that a ball will take and in selecting the direction of stroke. This device provides no assistance in measuring or gauging the slope or the speed of the surface that the ball is to roll across—the golfer, in accordance with the established rules of play, must make those estimates unaided. The device does, however, allow a golfer who has estimated the slope of a green in two mutually perpendicular directions to avoid confusion in combining those two estimates in his selection of an initial stroking path.

It is an object of the invention to provide a visual aid that will help the golfer to select an initial stroking path for a putt or other shot in which the ball rolls along the ground.

It is a further object of the invention to provide a training aid that will assist golfers in learning how to "read greens".

It is yet a further object of the invention to provide a visual putting aid that golfers can use in tournament play.

It is an additional object of the invention to provide a qualitative indication of the effect of gravity on an object rolling across a planar surface, the slope of which has been previously estimated in two mutually perpendicular directions.

Figure 1:
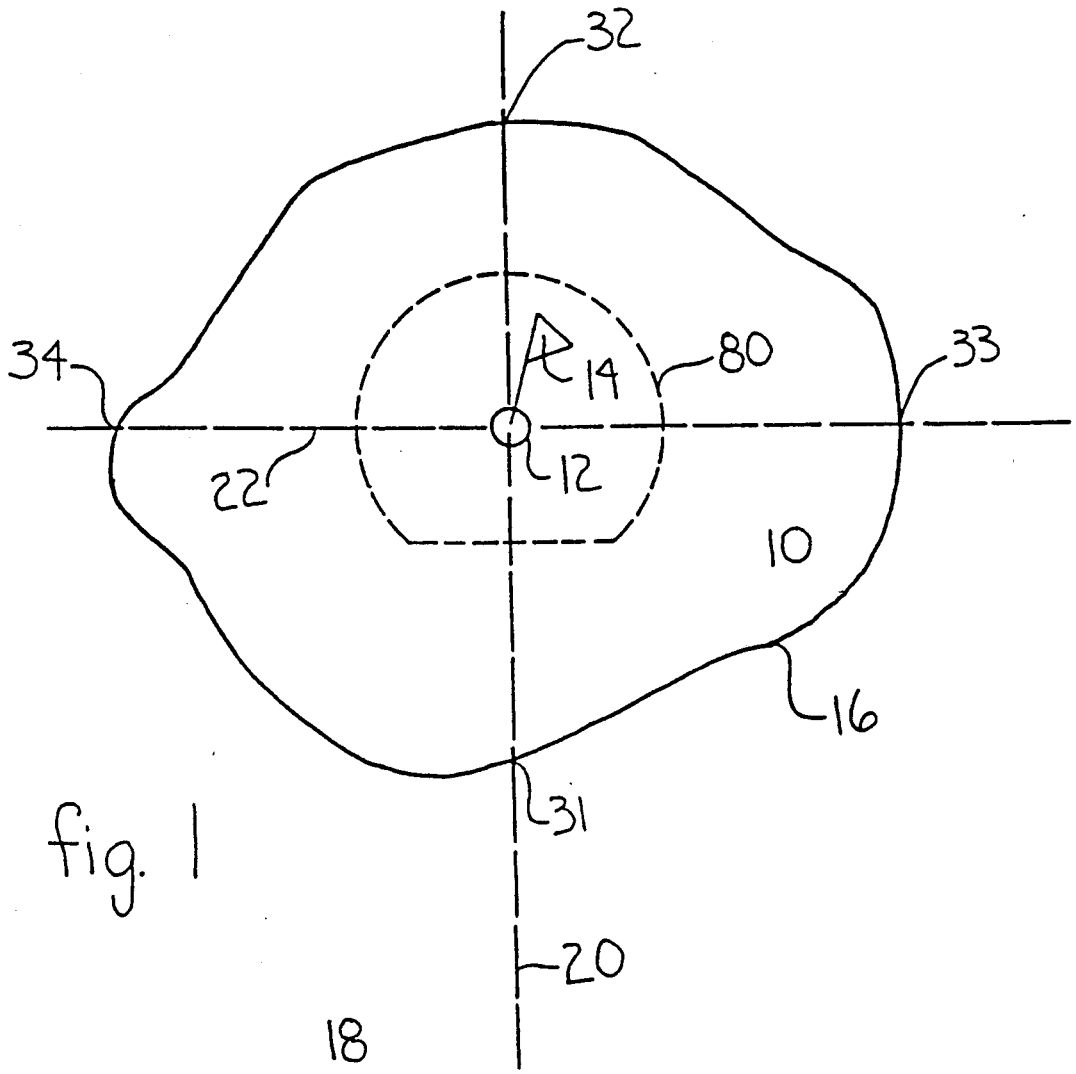
FIG. 1 of the drawing shows a green on a golf course and defines directions on the green.

FIGS. *2a–i* of the drawing qualitatively illustrate the rolling trajectories of golf balls stroked from various indicated positions toward a cup on nine different greens, each of which has a different combination of slopes along the characteristic directions defined in FIG. 1.

Figure 3:
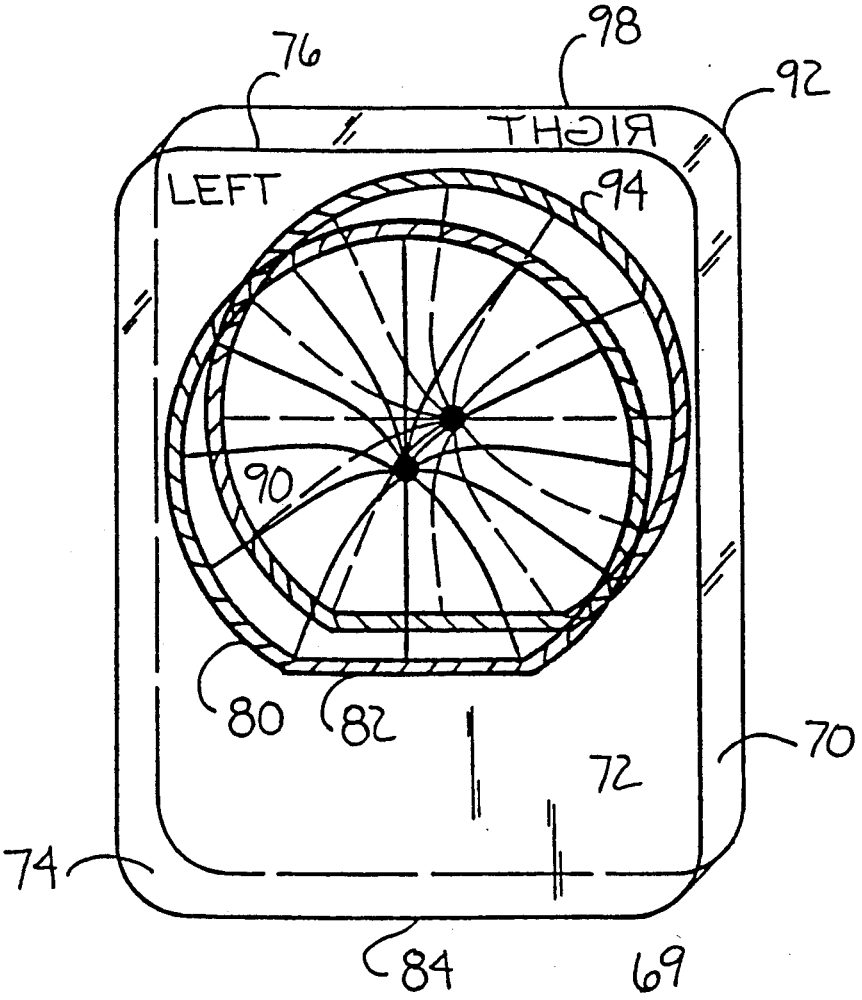

FIG. 3 of the drawing shows a perspective view of a preferred embodiment of the invented visual aid.

FIG. *4a* of the drawing shows the schematic of a golf green that appears on a first major surfaces of the visual aid of FIG. 3.

FIG. *4b* of the drawing shows the schematic of a golf green that appears on a second major surfaces of the visual aid of FIG. 3.

DESCRIPTION OF THE PREFERRED EMBODIMENT

Turning now to FIG. 1 of the drawing, one sees a general view of a golf green 10, with a cup 12, flag 14, and an edge 16 that separates it from the surrounding fairway 18. Two imaginary lines, 20, 22 are shown as dashed lines passing through the cup 12. One of these lines 20, extends down the center of the fairway 18 towards the tee (not shown). The other line 22 is drawn at right angles to the fairway centerline 20. Four positions 31, 32, 33, 34 are noted at the edge of the green and will be used in the following discussion. The front 31 and back 32 of the green 10 are defined by the intersections of the fairway centerline 20 with the edge 16. The front 31 is defined as the intersection closer to the tee and the back 32 is the further one. The right hand side of the green 33 is defined by the intersection of the line 22 with the edge 16, i.e. is at a 3 o'clock position if one looks down on the green from directly above. The left hand side 34 of the green is at the other intersection of imaginary line 22 and the edge 16 of the green.

As long as the green is a plane surface, elementary geometry assures us that one can describe its position by determining the inclination of any two lines. Most conveniently, one may select two mutually perpendicular lines, such as the imaginary lines 20 and 22 and then make the determination or estimation from the front 31 (or back 32) and right hand 33 (or left hand 34) edges of the green 10. Conversely, if the slope of the plane is known in two directions, which are conveniently chosen to be perpendicular, one can then, by a process of vector addition, determine the net result of the force of gravity upon a rolling ball. This resultant force and an estimate of the green's speed can be used to estimate a trajectory for the ball. A set of these estimated trajectories (all of which ignore the matter of green speed and all of which are drawn for slopes of the same magnitude) are shown in FIG. 2.

Figure 2A:
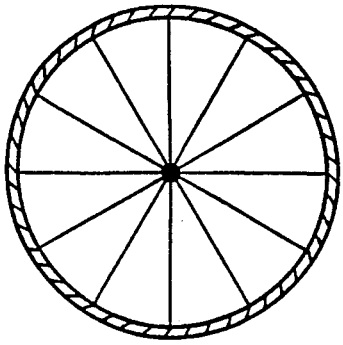
Figure 2B:
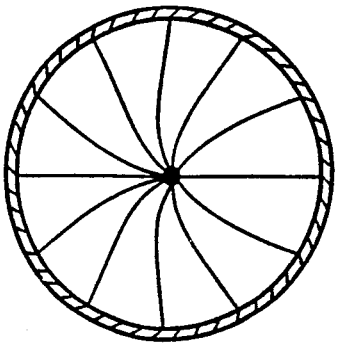
Figure 2C:
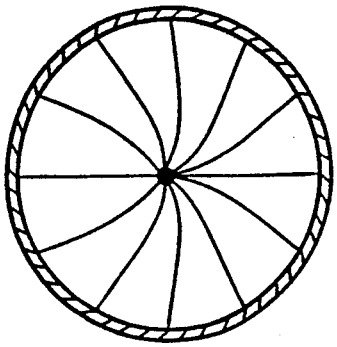
Figure 2D:
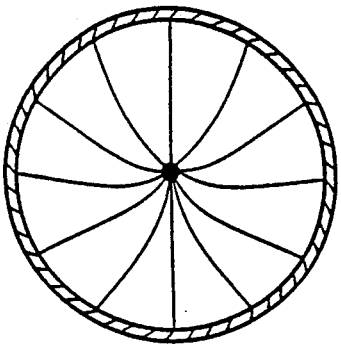
Figure 2E:
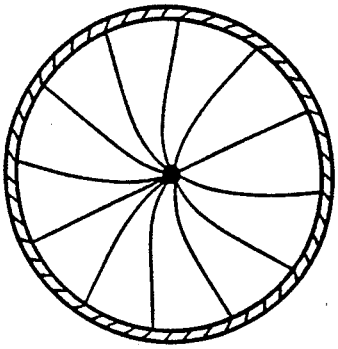
Figure 2F:
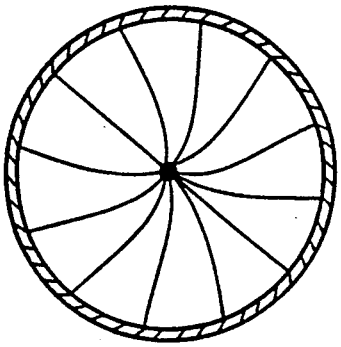
Figure 2G:
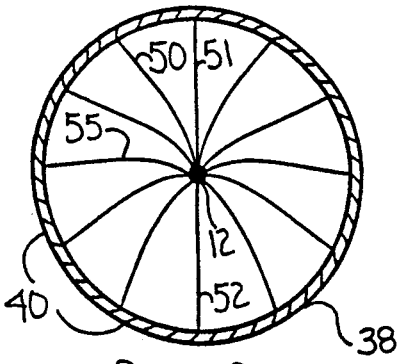

Turning now to FIG. 2*g* of the drawing, one finds a schematic representation of a green that slopes upward from the front to the back, and that is flat along a line from left to the right. An indicium, such as dot 12, representing the cup, is set at the center of a circle 38, and several possible initial positions 40 of balls that are to be putted are represented on the circumference of a circle 38. As a further means of providing easy reference for the user, twelve initial positions 40 are shown on the circle 38, each position corresponding to an hour's position on the face of a clock.

The set of curves 50 predict the paths that balls that are successfully putted from initial positions 40, will follow as they roll across the green into the cup 12. Except for two special cases 51, 52 where the ball lies directly uphill or directly downhill from the cup, the initial stroke direction (indicated in one example by a short dotted line segment 55, and generally being shown by that portion of the trajectory that is immediately adjacent the circle 38) does not lead directly from the ball to the cup.

Figure 2H:
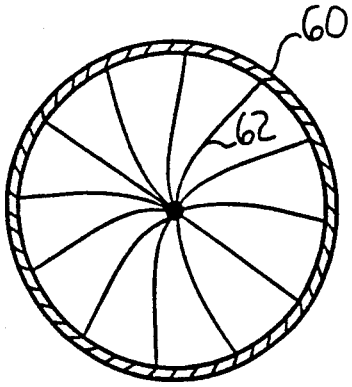
Figure 2I:
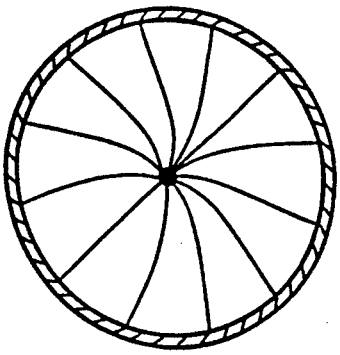

In general, a green may slope both front to back and left to right. Considering a hypothetical set of greens that either have slopes of a predetermined magnitude in one or both of the principal directions, or that are flat, one can generate the set of schematics shown in FIG. 2 of the drawing by considering all possible combinations of slopes. In these schematics the principal directions have been selected as discussed with respect to FIG. 1. The schematics are presented so that the front 31 of the green is at the bottom of the schematic when the figure is viewed from a normal reading position. Hence, FIG. 2*a* is a schematic representation of a green that has no slope front to back and no slope right to left—i.e. is completely flat;

FIG. 2*b* is a schematic representation of a green that has no slope front to back, and where the left hand side of the green is higher than the right;

FIG. 2*c* is a schematic representation of a green that has no slope front to back, and where the right hand side of the green is higher than the left;

FIG. 2*d* is a schematic representation of a green where the front of the green is higher than the back, and where there is no slope right to left;

FIG. 2*e* is a schematic representation of a green where the front of the green is higher than the back, and where the left hand side of the green is higher than the right;

FIG. 2*f* is a schematic representation of a green where the front of the green is higher than the back, and where the right hand side of the green is higher than the left;

FIG. 2*g* is a schematic representation of a green where the back of the green is higher than the front, and where there is no slope right to left;

FIG. 2*h* is a schematic representation of a green where the back of the green is higher than the front, and where the left hand side of the green is higher than the right; and FIG. 2*i* is a schematic representation of a green where the back of the green is higher than the front, and where the right hand side of the green is higher than the left.

In one embodiment of the invention, the set of graphical representations shown in FIG. 2*a–i* is printed on a card that can be used by a golfer as a visual aid in reading a green on which he is to putt. The golfer who uses the aid is instructed to estimate the slope of the green along the front-back (i.e. line 20 in FIG. 1) and left-right (i.e. line 22 in FIG. 1) and to then refer to the visual aid for a qualitative estimate of the path that a successful putt will take en route to the cup.

In general, a green will slope by differing degrees in the two principal directions, so as to render the qualitative estimate of the visual aid less accurate. Because of this, the golfer is instructed to note which of the estimated slopes is greater—i.e. to determine a dominant and a secondary slope. He or she can then modify the estimate provided by the visual aid by looking both at the schematic that nominally represents the situation and at that related view that would provide an estimate of the ball's path if the green were flat in the secondary direction. After viewing both exemplar trajectories, the golfer can imagine a resultant one that is intermediate between the two. For example, consider a ball lying at a 2 o'clock position on a green where the back is higher than the front and the left is higher than the right—i.e. at the position shown by reference numeral 60 on FIG. 2*h* of the drawing. If the magnitude of the front-back and left-right slopes are approximately equal, the golfer can use the curved line 62 as an indication of a trajectory of a successful putt, and can take the direction of that portion of the curved line 62 lying nearest the circle 38 as an approximate stroking direction for the ball—i.e. FIG. 2*h* indicates that the golfer should putt the ball a bit to the right of the cup as viewed from the ball's position 60. In the more general case where the two slopes differ, a modified reading is needed. As an extension of the present example, assume that the back-front slope is greater than the left-right slope. In this case, the golfer considers the schematics of both FIG. 2*h* and FIG. 2*g*, imagines a curved line intermediate between line 62 of FIG. 2*h* and line 64 of FIG. 2*g*, and uses that imagined curve as a guide for putting—i.e. after compositing the views of FIG. 2*g* and FIG. 2*h*, the golfer putts a bit more to the right than he would have had he only referred to the aid of FIG. 2*h*.

A more compact embodiment of the invention can be made by eliminating some of the views of FIG. 2. For example, FIG. 2*a* describes a case for which a visual aid is of little value—that of putting on a perfectly flat green. One may choose to drop that schematic. Moreover, if the user rotates the card on which the various schematics are printed, he or she can obtain the schematics of FIGS. 2*d–f* by merely rotating the card 180° about an axis perpendicular to the plane of the drawing and looking at the schematics of FIGS. 2*g–i*. Since the cases represented by FIGS. 2*d–f* are uncommon—i.e. since greens usually slope upward from the front—one may choose to eliminate these three schematics and instruct the user to turn the card around in cases where these unusual situations occur. Hence, one can print a visual aid for golfers that uses only 5 of the 9 views shown in FIG. 2—i.e. those of FIG. 2*b–c* and 2*g–i*. Such a reduction in the number of views may be useful, for example, if one wishes to provide relatively large schematic views on a relatively small card that the golfer may conveniently carry.

Figure 4A:
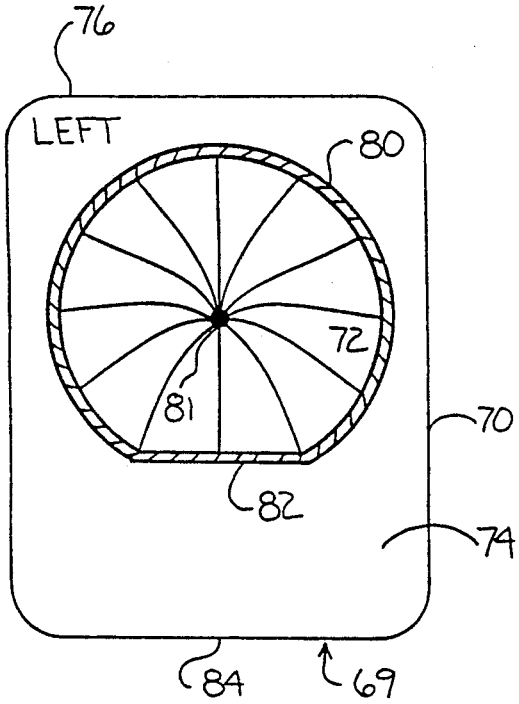
Figure 4B:
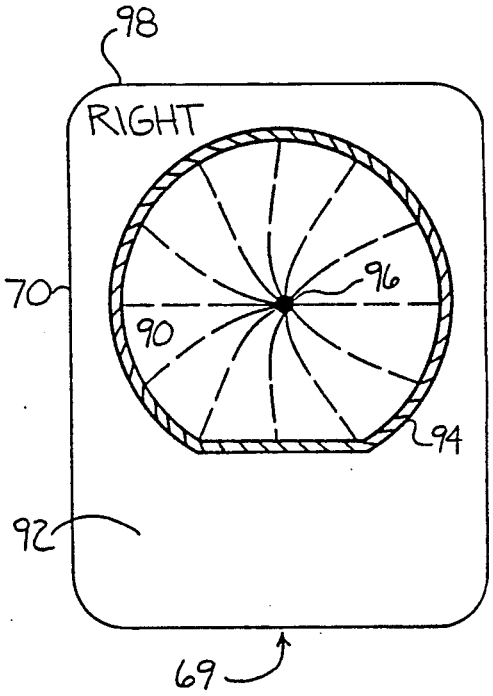

Turning now to FIGS. 3 and 4*a* of the drawing, one finds a preferred embodiment of the invention 69 in which a transparent substrate 70, generally having the shape of a flattened rectangular parallelpiped with rounded corners, is employed to allow the user to view two different schematics simultaneously and which thereby facilitates his or her ability to use the visual aid in common cases where the slopes of the green along the two principal directions differ in magnitude. That is, the transparent substrate of the preferred embodiment allows the user to readily form a prediction from the superposition of two schema rather than having to mentally form a prediction from two separate views. As will become apparent from the following discussion, it is convenient to provide means (e.g. the solid and dashed curves of FIGS. 3 and 4) of separating the effect of front-back slopes from left-right slopes in these schematics. It will be appreciated by one skilled in the art of graphical representation that other approaches (e.g. using different line weights or different line colors for the two sets of curves) could have been equally as well used to visually separate the effect of slopes along the two principal directions.

In the embodiment shown in FIGS. 3 and 4*a* of the drawing, a first schematic view 72 of a green where the back is higher than the front and there is no left-right slope (i.e. the schematic of FIG. 2*g*) is printed with solid curves on one major surface 74 of a transparent substrate 70. The world "LEFT" is printed at what the viewer would consider the top 76 of the schematic 72 to denote to the user that the aid is to be viewed from the direction of the surface 74 of the left side of the green is lower than the right—i.e. the view of FIGS. 3 and 4*a*. A deformed circle 80 is used to present the locus of ball positions, and a central dot or circle 81 is used to denote the cup. A flattened portion or straight line segment 82, on 80 towards the bottom edge 84 of surface 74 represents the front 31 of the green, and the provision of such an indicator on the deformed circle 80 serves as a reminder to the user as to the proper attitude in which the device 69 is to be held. (The proper attitude of deformed circle 80 is schematically indicated by a dotted deformed circle 85 on the green 10 of FIG. 1). A second schematic printing 90 (as shown both in FIG. 3, and with greater clarity, in FIG. 4*b*) is disposed on the second major surface 92 of the substrate 70 in general alignment with schematic 72 on surface 74—that is, the deformed circle 80 and dot 81 on surface 74 are in alignment with a deformed circle 94 and dot 96 on surface 92. The word "RIGHT" is printed at the top 98 of second major surface 92 of substrate 70 to denote to the user that the aid is to be viewed from the direction of the surface 92 if the right edge of the green is lower than the left.

If the user views the device 69 of FIG. 3 from the direction of the surface 74—e.g. the view of FIG. 4*a*—the schematic that is printed with solid curves on surface 74 describes the situation for a green that slopes upward from front to back and that has no left-right slope (i.e. the schematic of FIG. 2*g*), while the schematic 90 describes a green the slopes upward from left to right with no front-back slope (i.e. the schematic of FIG. 2*b*). If the viewer turns the device 69 over and views it front side 92 (e.g. from the side shown in FIG. 4*b*, he or she sees a superposition of schematics for a green sloping upward from front to back with no left-right slope (i.e. FIG. 2*g*—as represented by the solid curves of printing 72) and a schematic of a green that slopes upward from right to left with no front-back slope (i.e. FIG. 2*h*—as represented by the dashed curves of printing 90).

Turning the device over allows the printed schematics to be viewed from different sides. The same effect can be seen in FIG. 2 of the drawing if that figure is copied onto a transparent sheet and viewed from both sides—e.g. FIG. 2*h*, viewed from the printed side of the sheet, is the same as FIG. 2*b* viewed from the opposite side of the sheet.

Note that the unusual case where the green slopes downward from front to back can be accommodated by the device 69 of FIG. 3 if the user rotates the substrate 74 so that the word "LEFT" or "RIGHT" appears upside down.

The user of the visual aid 69 can readily adapt to greens that slope in both principal directions. When viewed from either side the user sees a set of pairs of generally curved lines that have common ends (i.e. all of the curves have one end at the cup 81,96, and the other end on a deformed circle 80,94). When the curves appear nearly superposed, the user notes that the two slopes are acting in an additive fashion, and that a maximum "break" is involved. When the curves arc in opposite directions the user notes that effects of the two slopes tend to cancel each other and that the putt will not break. Moreover, if the user determines that the green is more steeply sloped front-to-back, and is relatively flat left-to-right, he or she can readily determine that the solid curves of printing 72 are to be taken as dominant over the dashed curves of printing 90, etc.

Since the transparent substrate 70 has a finite thickness 105, cases where a curve of printing 72 is in registration with a curve of printing 90 need not lead to confusion for the viewer. Tilting the device 69 about an axis lying in the plane of the major surface 74 allows the user to view both sets of curves and to make an appropriate judgement as to the superpositions that are needed.

Although the preferred embodiment described above used solid curves in printing 72 and dashed curves in printing 90 to aid the user in discriminating between the two schematics, it should be noted that many other methods are known in the art for separately rendering two sets of graphic images that must viewed simultaneously. One could, for example, in the printing in FIG. 3, use thicker lines for printing 72 and thinner lines for printing 90, or vice versa. One could also consider rendering printing 72 in one color and printing 90 in a different color. Moreover, if the inks, dyes or pigments used for preparing different colored printings 72 and 90, were translucent, the user would see an additive color in cases where a curves of printing 72 was in registration with a curves of printing 90. This use of additive colors could, for example, allow for fabrication of the visual aid 69 by using translucent inks to prepare printings 72 and 90 on the same surface of a transparent substrate 70 without causing the apparent "loss" of an occluded curves.

Although the invention has been described with respect to a preferred embodiment and several other embodiments, it should be noted that many other modifications and designs can be made without departing from the spirit and nature of the invention, and that all such modifications and alterations are intended to lie within the scope of the claims hereto appended.

I claim:

1. A visual aid for use in the game of golf to assist a player in estimating the effects of gravity on a rolling path of a putted ball, said aid comprising a sheet whereon is printed a plurality of schematic graphic views of a golfing green, said green having a front, a back, a right side and a left side, wherein a close curve on a said graphic view denotes a plurality of initial possible positions of said ball, an indicium on a said graphic view denotes a cup, a trajectory-denoting curve on a said graphic view extends from a said closed curve to said indicium and denotes a path that said ball, stroked from a said initial position, could follow to said cup, and wherein a first 2(*g*) of said views schematically represents a first green sloping upward from said front to said back and being relatively flat along a line from said right side to said left side, a second 2(*b*) of said views schematically represents a second green sloping upward from said right side to said left side and being relatively flat along a line from said front to said back, a third 2(*c*) of said views schematically represents a third green sloping upward from said left side of said right side and being relatively flat along a line from said front to said back, a fourth 2(*h*) of said views schematically represents a fourth green sloping upward from said right side to said left side and sloping upward from said front to said back, a fifth 2(*i*) of said views schematically represents a fifth green sloping upward from said left said to said right side and sloping upward from said front to said back.

2. A visual aid of claim 1 wherein said closed curve comprises a straight line segment denoting said front of said green and a circular arc extending from a first end of said straight line segment to a second end of said straight line segment.

3. Apparatus for use in the game of golf to assist a player in visualizing the effects of gravity on a rolling path of a ball putted on a golfing green, said green having a front, a back, a right side and a left side, said apparatus comprising a transparent body having an upper surface and a lower surface separated by a thickness that is less than a lateral extent of said upper surface, said upper surface having printed thereon a schematic graphic view of a first exemplary golfing green, said first exemplary green sloping upward from its front to its back and being relatively flat along a line from its right side to its left side, said lower surface having printed thereon a schematic graphic view of a second exemplary golfing green, said second exemplary green being relatively flat along a line from its front to its back and sloping upward along a line from its right side to its left side, and wherein each said graphic view includes a closed curve denoting a plurality of initial possible positions of a golf ball, an indicium denoting a cup, and a trajectory-denoting curve extending from a said initial position on a said closed curve to said indicium and denoting a path that said ball, stroked from said initial position, could follow to said cup.

4. Apparatus of claim 8 wherein a first trajectory-denoting curve denoting a path for a ball rolling on said first exemplary green is printed on said upper surface as a solid curve, and a second trajectory-denoting curve denoting a path for a ball rolling on said second exemplary green is printed on said lower surface as a broken curve.

5. Apparatus of claim 8 wherein a first trajectory-denoting curve denoting a path for a ball rolling on said first exemplary green is printed on said upper surface in a first color, and a second trajectory-denoting curve denoting a path for a ball rolling on said second exemplary green constitute lines is printed in a second color.

6. Apparatus of claim 5 wherein a superposition of said first and said second graphic views results in a composite graphic view including curves of a third color additively formed from said first and said second colors.

* * * * *